United States Patent [19]

Fleming et al.

[11] Patent Number: 4,807,914

[45] Date of Patent: Feb. 28, 1989

[54] WINDOW LOCK ASSEMBLY

[75] Inventors: Paul D. Fleming, Glendale; Nandor Gajer, Woodland Hills, both of Calif.

[73] Assignee: W & F Manufacturing, Inc., Glendale, Calif.

[21] Appl. No.: 897,793

[22] Filed: Aug. 18, 1986

[51] Int. Cl.[4] ..... E05C 3/08

[52] U.S. Cl. ..... 292/48; 49/394; 292/196; 292/240; 292/DIG. 7; 292/DIG, 20; 292/DIG. 31

[58] Field of Search ..... 292/240, 45–49, 292/199, 200, 196, 11, 197, DIG. 7, DIG. 20, DIG. 33, DIG. 47, 51–53, 161, DIG. 31; 49/394

[56] References Cited

U.S. PATENT DOCUMENTS

| | | | |
|---|---|---|---|
| 552,950 | 1/1986 | Abbott et al. | 292/199 X |
| 708,097 | 9/1902 | Tower | 292/240 |
| 1,019,623 | 3/1912 | Fleming et al. | 292/DIG. 31 X |
| 1,131,247 | 3/1915 | Kiekert | 292/51 |
| 1,180,619 | 4/1916 | Strelesik | 292/199 X |
| 1,370,109 | 3/1921 | Hart | 292/DIG. 20 X |
| 2,708,302 | 5/1955 | Wilkirson | 292/240 |
| 4,003,614 | 1/1977 | Geer et al. | 292/240 X |
| 4,300,794 | 11/1981 | Dunsmoor | 292/DIG. 31 X |
| 4,610,472 | 9/1986 | Billingsley et al. | 292/54 |

FOREIGN PATENT DOCUMENTS

| | | | |
|---|---|---|---|
| 626330 | 2/1936 | Fed. Rep. of Germany | 292/161 |
| 847714 | 8/1952 | Fed. Rep. of Germany | 292/52 |
| 197715 | 5/1958 | Fed. Rep. of Germany | 292/45 |
| 511891 | 1/1921 | France | 292/199 |
| 1132373 | 11/1956 | France | 292/52 |
| 1300293 | 6/1962 | France | 292/199 |
| 103502 | 1/1942 | Sweden | 292/48 |
| 322925 | 8/1957 | Switzerland | 292/161 |

*Primary Examiner*—Lloyd A. Gall

*Attorney, Agent, or Firm*—Kelly, Bauersfeld & Lowry

[57] ABSTRACT

A window lock assembly is provided for facilitated locking of a pane-carrying frame or sash in a closed position with respect to a window casement. The lock assembly comprises a handle unit in a recessed, substantially flush-mounted position on the casement and including a movable operator handle connected by a concealed rack or the like to at least one locking cam unit mounted on the casement at a remote position relative to the operator handle. The operator handle is accessible for manual movement to displace a locking cam of the cam unit into releasable locking engagement with a keeper mounted on the sash.

17 Claims, 5 Drawing Sheets

WINDOW LOCK ASSEMBLY

BACKGROUND OF THE INVENTION

This invention relates generally to an improved lock assembly for use in securely locking windows and the like in a closed position. More specifically, this invention relates to an improved window lock assembly designed for facilitated yet secure locking of a window wherein the lock assembly is at least partially concealed from view and further does not interfere with a wide range of popular window coverings and treatments.

Many different types of windows are known for use in residential and/or commercial structures wherein the window includes movable frame components permitting the window to be opened and closed. For example, sliding windows are well known having a movable window frame or sash carrying a transparent pane or the like and mounted to slide horizontally or vertically between open and closed positions within a stationary window casement. Another popular window design includes a pane-carrying sash or the like hinged onto a stationary casement for movement between open and closed positions. In general, these windows desirably include lock devices accessible typically from the indoor side of the window for releasably locking the window in the closed position, thereby preventing unauthorized entry into a building.

The art includes a wide variety of window lock devices adapted for use in locking windows of various construction. For example, cam-type locks, sliding pin locks, and other latch lock devices have been used for many years and commonly include a lock component mounted on the stationary casement and movable when the window is closed to engage a mating keeper or the like on the movable window sash. However, such lock devices have traditionally been mounted on the window at positions selected for optimum security and without concern for ease of manual access to operate the lock device. As a result, in many instances, the lock device is positioned at a vertical elevation where it is difficult to reach, particularly by shorter persons. Alternately, attempts to relocate the lock device in a position for easier access and more convenient operation typically place the lock device in an unattractive position.

Remote lock actuator mechanisms have been proposed to operate window lock devices, wherein the mechanism includes a conveniently positioned actuator or handle designed to operate an otherwise difficult to reach window lock device. Such mechanisms have included, for example, elongated rods mounted on a window casement for facilitated displacement to correspondingly operate one or more latch lock devices at remote positions. However, these remote actuator mechanisms have typically been mounted in an unsightly manner with substantially the entire structure visible from the indoor side of the window. Moreover, such mechanisms have required mounting in a position within the bounds of the window casement whereas the mechanism interferes with many popular window coverings and treatments, such as Venetian blinds, mini blinds, shutters, pull-down shades, fold-up shades, and the like.

There exists, therefore, a significant need for an improved window lock assembly, wherein the lock assembly is integrated into the stationary casement to avoid interference with window treatments, and wherein the lock assembly includes a conveniently positioned actuator connected in a concealed manner to operate a remotely positioned lock device. The present invention fulfills these needs and provides further related advantages.

SUMMARY OF THE INVENTION

In accordance with the invention, an improved window lock assembly is provided for releasably locking a window or the like in a closed position. The window lock assembly includes a movable operator handle installed substantially in a flush-mounted position within the outer stationary casement of a window frame. The operator handle is coupled in a concealed manner to one or more lock devices at remote positions on the casement for displacing those lock devices into locking engagement with associated keepers on a movable window sash or frame supporting a transparent pane or the like.

In one preferred form of the invention, the window lock assembly is designed for use with a window having a pane-carrying sash hinged onto the stationary outer casement for swinging movement between opened and closed positions. Alternately, the invention can be adapted for use with other types of window structures, such as sliding windows or the like.

The window lock assembly includes a handle unit recessed or built into the outer casement at a convenient location and in a substantially flush-mounted manner at one side of the casement. The handle unit includes a housing having slots therein for receiving an elongated rack extending from the housing through internal channels formed within the casement at concealed positions. The operator handle is pivotally movable within the handle unit housing and carries a toothed slide block in meshed engagement with the rack. Pivoting motion of the operator handle within the handle unit housing displaces the rack back and forth within the channels.

The rack extends from the handle unit to a remote position in meshed engagement with at least one lock device which is also mounted on the casement in a recessed, substantially flush-mounted manner. The preferred lock device comprises a locking cam unit having a locking cam movably mounted within a cam unit housing which has an opening therein presented toward the sash when the sash is at or near the closed position. Movement of the operator handle, as previously described, displaces the rack in a manner to move the locking cam into secure locking engagement with a keeper on the sash. The locking cam is desirably shaped to included a contoured draw surface to draw the sash to a tightly closed and securely locked position. Opposite movement of the operator handle moves the locking cam in an opposite direction to release the keeper and permit window opening.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
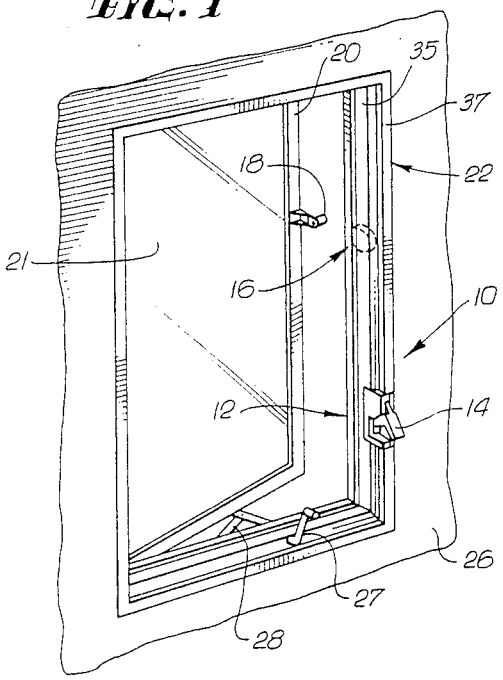
FIG. 1 is a fragmented perspective view illustrating a window including an improved window lock assembly embodying the novel features of the invention.
Figure 2:
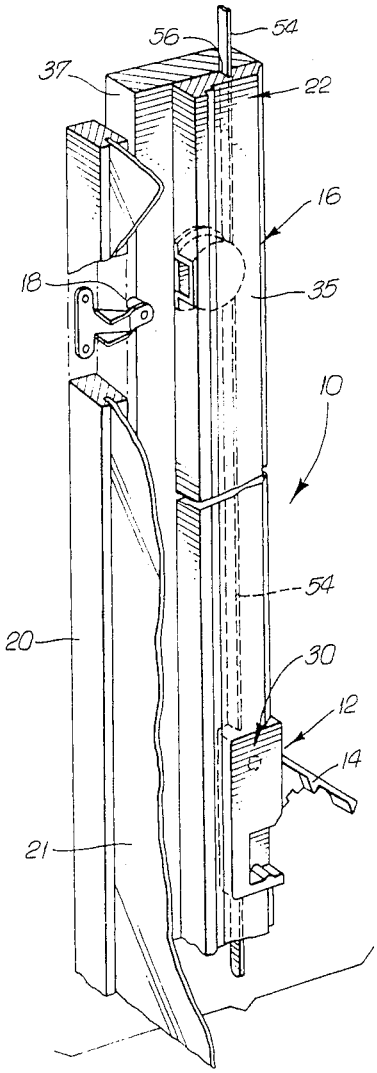
FIG. 2 is an enlarged, exploded and fragmented perspective view illustrating remote mounting of a handle unit and a locking cam unit forming the improved window lock assembly.

As shown in the exemplary drawings, an improved window lock assembly is referred to generally in one preferred form by the reference numeral 10 in FIGS. 1 and 2. The window lock assembly 10 includes a handle unit 12 having a movable operator handle 14 for operating a locking cam unit 16 or the like at a remote position for releasable locking engagement with a keeper 18 on the movable sash 20 of a window. The sash 20 supports a conventional transparent pane 21 of glass or any other suitable window closure.

The improved window lock assembly 10 of the present invention is designed for integration directly into the stationary outer casement 22 of a window frame assembly of any standard type adapted for permanent or semi-permanent mounting into the wall 26 of the like of a building. The handle unit 12 and the locking cam unit 16 are advantageously mounted into the casement 22 in partially concealed, substantially flush-mounted positions without any significant protrusions extending into the open interior circumscribed by the casement wherein such protrusions otherwise could potentially interfere with selected window coverings and treatments, such as blinds, shutters, shades, and the like (not shown). Moreover, the interconnection between the handle unit 12 and the locking cam unit 16 is concealed from view within the casement for optimum attractiveness.

As shown in FIGS. 1-6 in the illustrative preferred embodiment of the invention, the handle unit 12 is mounted in one stile of the outer casement 22 in a selected, convenient position with the operator handle 14 exposed to the indoor side of the casement for facilitated grasping and manipulation. For example, the handle unit 12 is shown in FIG. 1 near the lower end of one casement stile at the open side of the sash 20 which is supported by a vertically extending hinge (not shown) at the opposite stile. A rotatable crank 27 and bar linkage 28 are separately provided for use in cranking the sash 20 between open and closed positions. However, the left to right orientation of the window components can be varied as desired, and/or other types of windows such as vertically or horizontally sliding windows can be used. In any case, the handle unit 12 is normally positioned near the bottom of the casement for easy access by relatively short individuals, although any other convenient casement position can be used.

Figure 3:
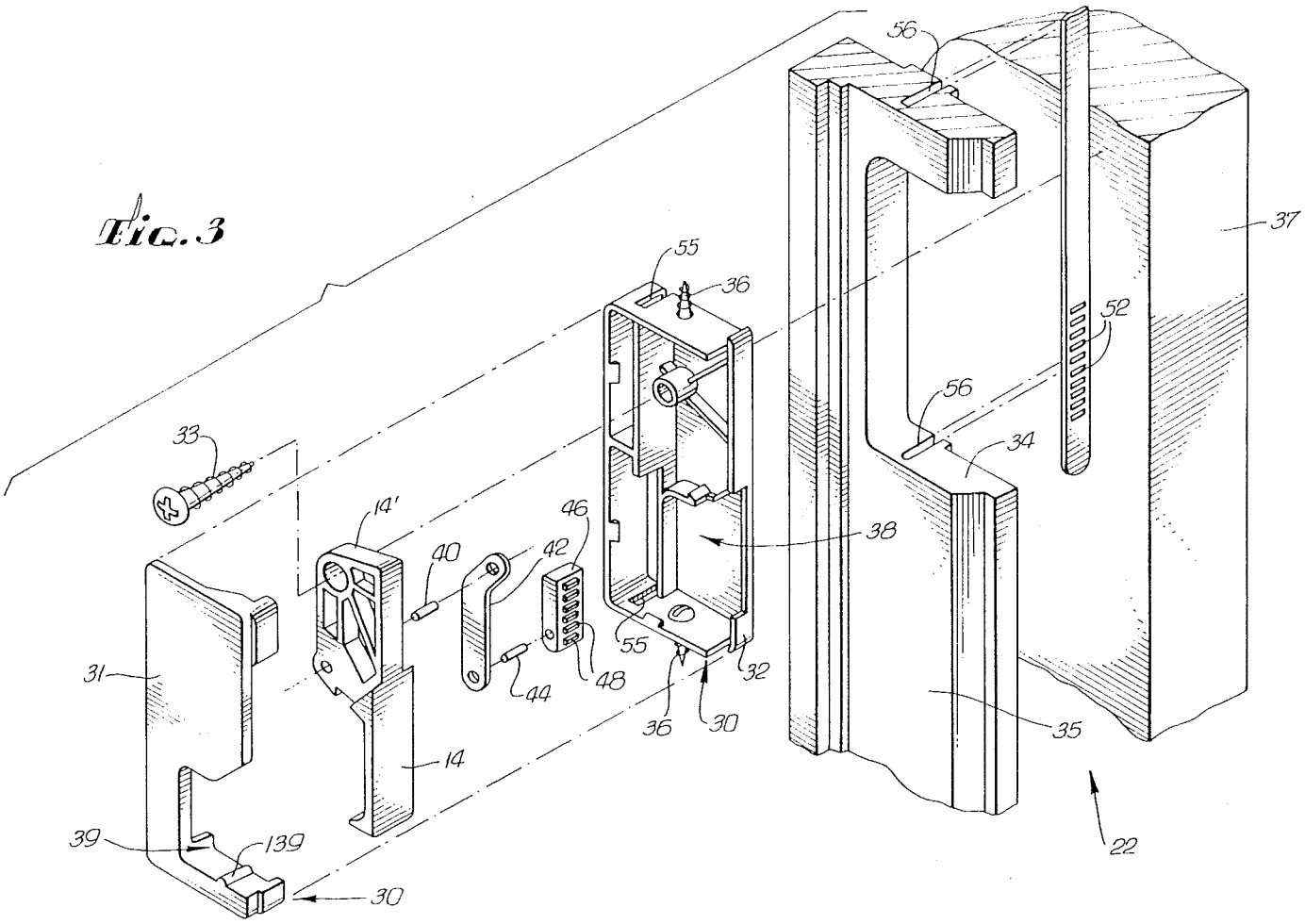
FIG. 3 is an enlarged, exploded and fragmented perspective view of the handle unit.

The illustrative handle unit 12 comprises a compact handle unit housing 30 which may be formed conveniently from a lightweight molded plastic or the like to include housing halves 31 and 32 as viewed in FIG. 3. These housing halves 31 and 32 are assembled in mated relation preferrably by snap fit interconnection or the like and are adapted for seated reception within a cavity or cut-out 34 formed in an inside stop strip 35 of the casement to open in a direction toward the indoor side of the window. Mounting screws 36 are normally provided to anchor the housing 30 within the stop strip cavity 34, although other types of fastening means can be used. In a typical casement assembly, the inside stop strip 35 is in turn secured within an outer frame member 37 and cooperates therewith to define the casement 22 adapted to installation into the building wall 26. Alternately, the stop strip 35 can be adapted for installation against the frame member of an already-installed window casement.

The operator handle 14 may also be formed from lightweight plastic or the like and has an upper body portion 14' pivotally supported and captured between the mated housing halves 31 and 32. A pivot screw 33 is conveniently passed through the upper end of the handle 14 (FIG. 3) and an aligned pivot boss on the housing half 32 for fastening directly into the outer frame member 37, thereby anchoring the handle relative to the frame member 37 rather than with respect to the plastic housing 30. A lower end of the handle 14 extends downwardly from the body portion 14' in a normal closed and locked position substantially within a handle unit chamber 38 defined by the housing 30. Importantly, in this position, the handle unit 12 including the housing 30 and operator handle 14 are positioned substantially flush with respect to the casement 22, as shown best in FIGS. 4 and 5, with a small ridge stop 139 at the bottom of the chamber 38 preventing inward overtravel. Significant protrusions laterally beyond the stop strip 35 into the interior region of the window are avoided to correspondingly avoid undesirable interference with selected window coverings and treatments. However, the laterally inboard side of the housing 30 is partially open, as indicated by arrow 39 in FIG. 3, to permit easy manual grasping of the lower end of the operator handle 14, as will be described in more detail.

Figure 4:
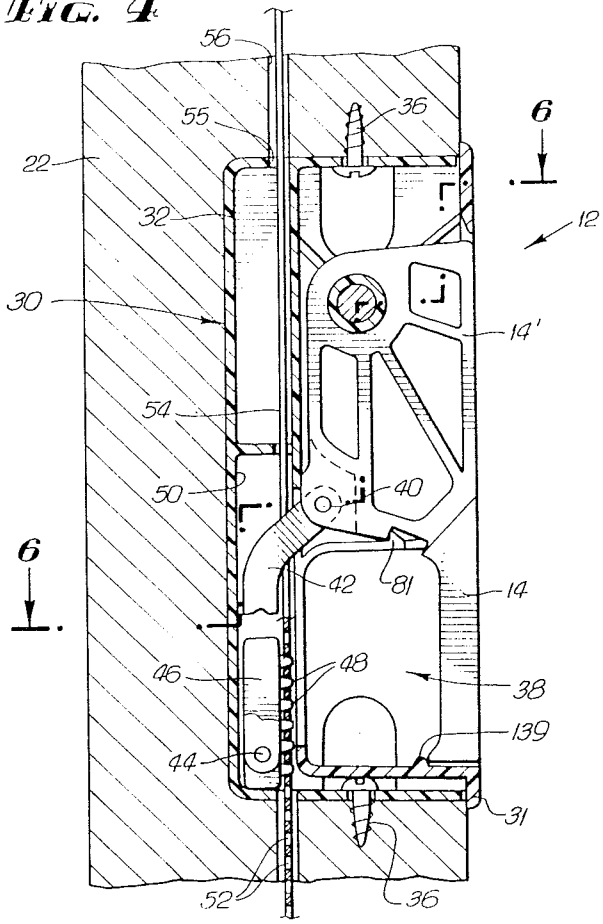
FIG. 4 is an enlarged fragmented vertical sectional view illustrating the handle unit in a normal closed position.
Figure 5:
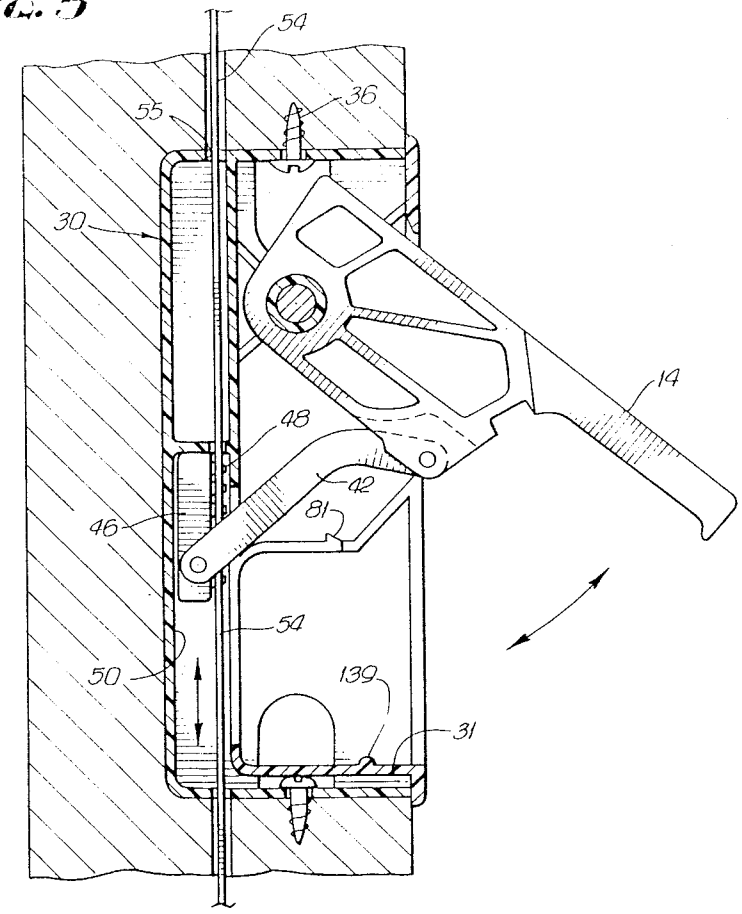
FIG. 5 is an enlarged fragmented vertical sectional view similar to FIG. 4 but showing the handle unit in an opened position.
Figure 7:
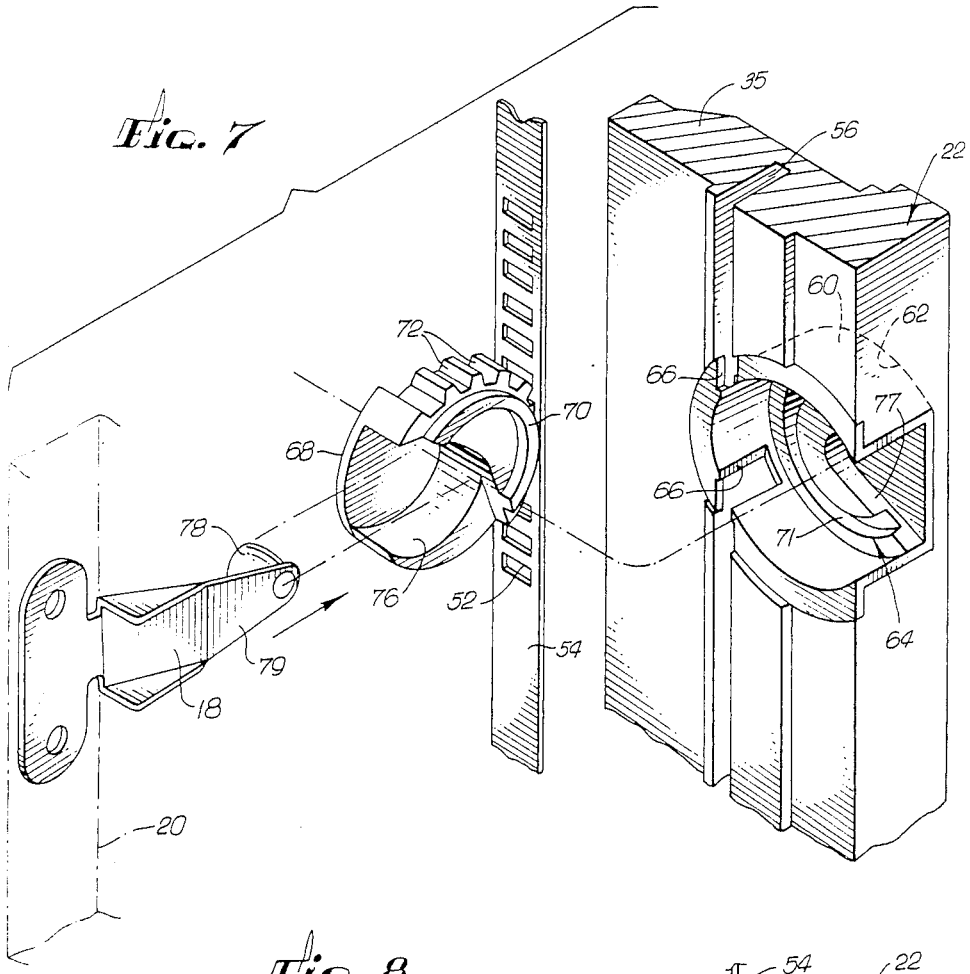
FIG. 7 is an enlarged, exploded and fragmented perspective view of the cam unit and keeper.

The body portion 14' of the operator handle 14 is pivotally connected by a pin 40 to one end of an actuator link 42. The opposite end of this actuator link 42, as shown best in FIGS. 4 and 5, is connected via a pivot pin 44 to a slider block 46 having a vertically spaced row of teeth 48 formed thereon. The slider block 46 is constrained within a vertically oriented track 50 formed between the housing halves 31 and 32 for up and down sliding movement along a linear path in accordance with pivoting movement of the operator handle 14 between the open and closed positions, as viewed respectively in FIGS. 4 and 5.

The teeth 48 on the slider block 46 are meshed within a correspondingly numbered and spaced plurality of openings 52 formed in a vertically extending rack 54. This rack, which is formed from a relatively stiff material such as a strip of steel or the like, extends through slots 55 in the handle unit housing 30 and further through aligned channels 56 formed in the stop strip 35 to the locking cam unit 16. In this regard, these channels 56 are formed at the outboard side of the stop strip 35 for convenient closure by the outer frame member 37 thereby retaining the rack for longitudinal sliding motion within the channels. The rack and channels are thus substantially completely concealed from view when the casement is installed normally into the wall 26 of the building.

As shown in FIGS. 7–10, the illustrative locking cam unit 16 comprises a generally cup-shaped cam unit housing 60 of molded plastic or the like seated within a blind bore 62 formed into the casement stop strip 35 and opening in an outboard direction whereby the bore 62 is closed by the outer frame member 37 (not shown in FIG. 7) when the casement is assembled. One side of this cup-shaped housing 60 is truncated to define an opening 64 presented toward the outdoor direction, whereas the other side of the housing 60 includes vertically aligned slots 66 for through passage of the rack 54 within the channel 56.

Figure 8:
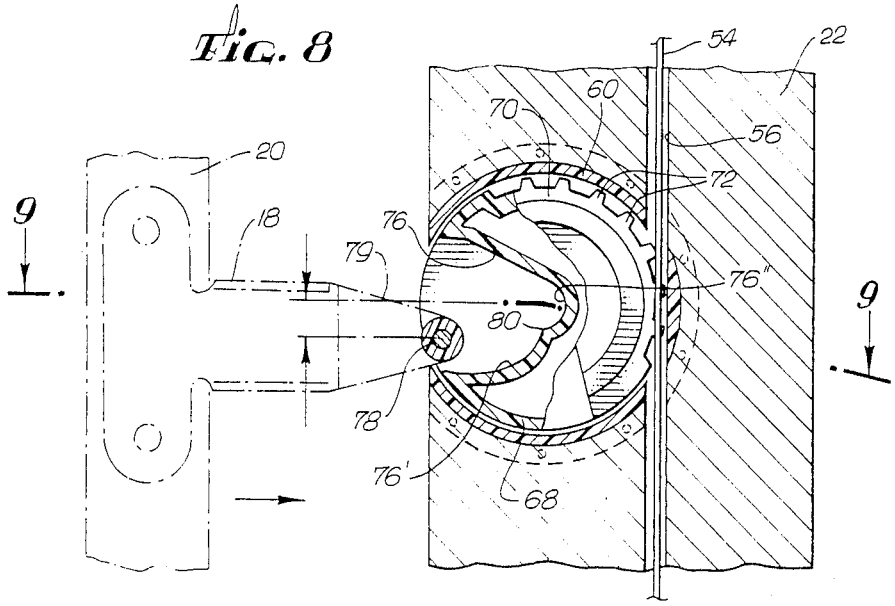
FIG. 8 is an enlarged fragmented vertical sectional view showing the cam unit in an initial position for engaging and locking with a keeper on the movable sash of the window.
Figure 9:
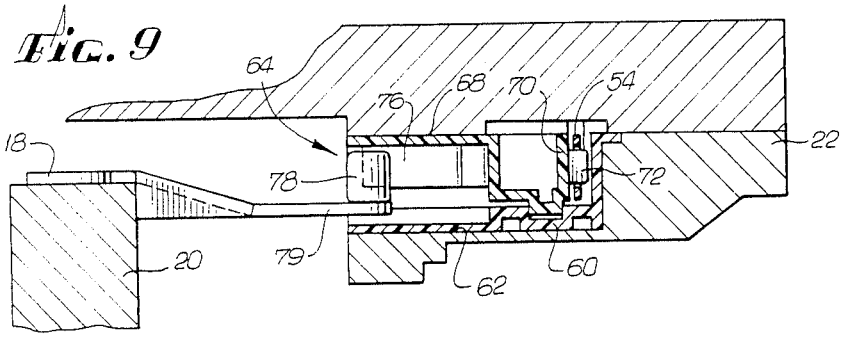
FIG. 9 is a fragmented horizontal sectional view taken generally along the line 9—9 of FIG. 8.
Figure 10:
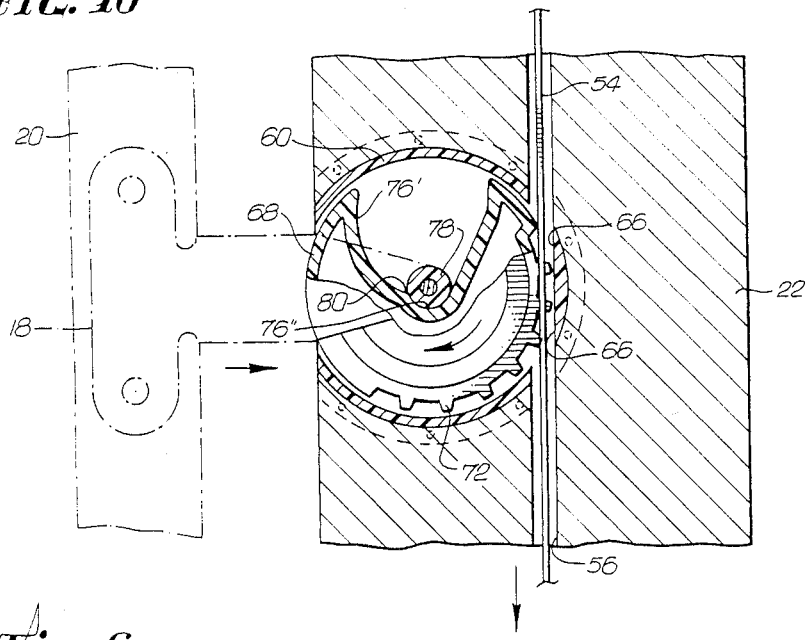
FIG. 10 is an enlarged fragmented vertical sectional view similar to FIG. 8 but illustrating the cam unit in locked engagement with the sash keeper of the window.
Figure 6:
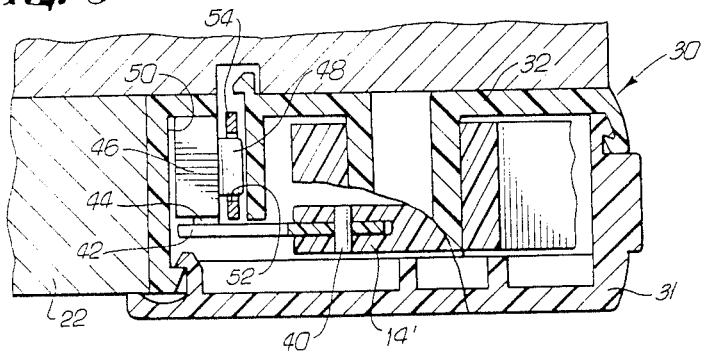
FIG. 6 is an enlarged fragmented horizontal sectional view taken generally along the line 6—6 of FIG. 4.

The cam unit 16 further includes a rotatable locking cam 68 which may also be formed from a lightweight plastic material, if desired. The locking cam 68 is received into the cam unit housing 60 and is thus trapped between the blind side of the bore 62 and the outer frame member 37. This locking cam 68 is defined in part by an arcuate, part-cylindrical rim 70 seated within a mating part-circle recess 71 in the cam housing 60 to rotatably support the cam 68. In addition, the cam 68 includes an accurate array of outwardly radiating teeth 72 engaged into an additional set of aligned openings 52 in the rack 54. The locking cam 68 further includes a contoured internal cam lobe 76 of roughly V-shaped geometry (FIG. 8). When the operator handle 14 of the handle unit 12 is in the open position as viewed in FIG. 5, this cam lobe 76 generally mates and aligns with a similar V-shaped recess 77 in the cam housing 60 to open genreally in the outdoor direction through the opening 64 in the cam unit housing 60 for ready reception of a roller 78 at the distal end of the keeper 18 on the sash 20.

When the keeper roller 78 is thus received, roller support blade 79 of the keeper is seated within the housing recess 77. Movement of the operator handle to the closed and locked position as viewed in FIG. 4 effectively rotates the locking cam 68 within the housing 60 to securely draw and lockingly engage the keeper roller. For best results, the cam lobe 76 is shaped to include a contoured draw surface 76' (FIG. 8) for drawing the keeper 18 into the cam unit housing upon initial locking cam rotation, in combination with a lock seat 76'' separated from the draw surface 76' by a shallow raised ridge 80 for securely retaining the keeper in the locked position, as viewed in FIG. 10. A snap catch 81 on the housing half 31 (FIG. 4) conveniently engages with a notch in the handle 14 to releasably lock the handle in the closed and locked position.

Return motion of the operator handle 14 within the handle unit housing toward the open position (FIG. 5) shifts the rack back toward the open position, thereby rotating the locking cam back toward the open position a viewed in FIG. 8. The keeper 18 is thus released to permit the window sash frame to be returned to an open position.

The improved window lock assembly of the present invention thus provides a secure lock structure of relatively simple design and which does not interfere with window coverings or treatments which may extend into the area circumscribed by the window casement. The handle unit 12 is mounted in a convenient position for easy access and operation of the remotely positioned locking cam unit 16. The interconnection between the handle and cam units is advantageously concealed directly into the casement to prevent viewing thereof during normal operation of the window.

Figure 11:
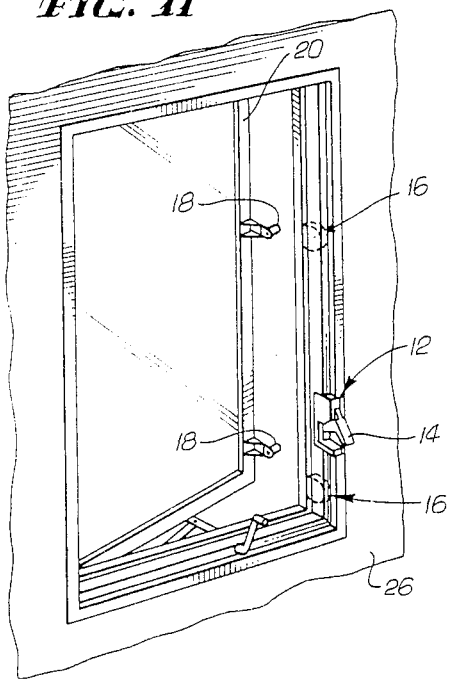
FIG. 11 is a fragmented perspective view similar to FIG. 1 but illustrating an alternative preferred form of the invention.

If desired, as depicted generally in FIG. 11, the window lock assembly of the invention can be adapted to include a single handle unit 12 for operating a pair of vertically spaced cam units 16 to engage and lock respectively with a vertically spaced pair of keepers 18 on a window sash 20. In this embodiment, the handle unit 12 includes a movable handle 14 as previously described herein for displacing a rack (not shown in FIG. 11) within a concealed track or channel. However, unlike the rack shown and described with respect to FIGS. 1–10, this version of the invention requires the rack to extend upwardly and downwardly from the handle 14 for simultaneously operating rotatable locking cams within the spaced cam units 16 to lock with the pair of keepers 18. When dual cam units are used to obtain two-point locking with the sash 20, the contoured drawn surface (FIGS. 8 and 10) of the upper locking cam is preferrably shaped for secure drawing and locking of the window, whereas the lower cam is shaped with at least some lost motion or freedom.

A variety of further modifications and improvements to the invention described herein are believed to be apparent to those skilled in the art. Accordingly, no limitation of the invention is intended by way of the description and drawings herein, except as set forth in the appended claims.

What is claimed is:

1. A window and lock assembly combination for releasably locking a first frame component of a window in a closed position with respect to a second frame component, comprising:

at least two lock devices mounted on said second frame component at spaced apart positions and each movable between locked and unlocked positions;

at least two keepers on said first frame component for locking engagement respectively with said first and second lock devices when said lock devices are in said locked positions and said first frame component is substantially in the closed position;

an actuator mounted on said second frame component at a position remote from said lock devices, said actuator including a handle, and means for pivotally supporting said handle for movement between first and second positions relative to said second frame component for correspondingly moving said lock devices between said locked and unlocked positions, said means for pivotally supporting said handle orienting said handle in a position substantially flush with said second frame component when said handle is in said first position;

said actuator further including means defining a track, and a slide block coupled to said handle and slidable along said track upon movement of said handle between said first and second positions; and an elongated rack carried by said slide block and extending from said slide block to said lock devices for displacing said lock devices between said locked and unlocked positions upon movement of said handle between said first and second positions, said rack extending substantially concealed from view within a channel formed in said second frame component.

2. A window and lock assembly combination for releasably locking the window in a closed position, comprising:

a stationary window casement;

a sash supported by said casement for movement between open and closed positions;

a handle unit mounted on said casement in a substantially flush manner and including an accessible operator handle movable between locked and unlocked positions, said handle unit including a handle unit housing halving said operator handle pivotally supported therein, and a slide block constrained for sliding movement within said handle unit housing in response to pivoting movement of said operator handle;

at least one locking cam unit mounted on said casement in a substantially flush manner and including a locking cam movable between locked and unlocked positions, said locking cam unit including a cam unit housing having said locking cam rotatably supported therein.

rack means operably connected between said slide block and said locking cam and extending therebetween through a channel formed in said casement in a position concealing said rack means from view during normal operation, said rack means displacing said locking cam between said locked and unlocked positions upon corresponding operator handle movement between said locked and unlocked positions, said rack means extending into said handle unit and locking cam housings through slots formed therein in general alignment with said channel, said rack means having openings spaced along the length thereof, said slide block and said locking cam including tooth means engaged within said rack means openings; and a keeper on said sash for engagement by said locking cam upon movement thereof to said locked position when said sash is substantially at said closed position;

said casement including an inside stop strip and an outer frame member, said channel being formed in said casement cooperatively between said stop strip and frame member.

3. The combination of claim 2 wherein said locking cam includes a contoured cam surface defining a draw surface for engaging said keeper and drawing said sash toward a tightly closed position upon locking cam rotation toward said locked position, and a seat surface for engaging said keeper when said locking cam is in said locked position to retain said sash in the tightly closed position, said draw and seat surfaces being separated by a raised ridge.

4. The combination of claim 2 further including a pivot link coupled between said operator handle and said slide block.

5. The combination of claim 2 further including a roller on said keeper for engagement by said locking cam.

6. The combination of claim 2 wherein said at least one cam unit comprises a pair of cam units on said casement, and wherein said keeper comprises a pair of keepers on said sash, said rack means being operably connected to both of said cam units.

7. The combination of claim 2 further including snap catch means for releasably retaining said handle unit in the locked position.

8. A window and lock assembly combination for releasably locking a first frame component of a window in a closed position with respect to a second frame component, comprising:

a lock device on said second frame component and movable between locked and unlocked positions;

keeper means on said first frame component for locking engagement with said lock device when said lock device is in the locked position and said first frame component is substantially in the closed position;

actuator means on said second frame component at a position remote from said lock device; and means interconnecting said actuator means and said lock device for moving said lock device between said locked and unlocked positions upon movement of said actuator means, said interconnecting means being substantially concealed from view, said interconnecting means comprising an elongated rack extending through a channel formed in said second frame component, said actuator means and said lock device including means for engagement with said rack, said second frame component comprising a window casement defined by an inside stop strip and an outer frame member with said channel being formed therebetween;

said lock device and said actuator means being mounted substantially flush within the second frame component when said actuator means is in a position to place said lock device in said locked position;

said actuator means comprising a handle unit having a housing mounted substantially flush within said second frame component, an operator handle pivotally mounted in an accessible position within said housing, and a slide block constrained for movement within a track defined by said housing and coupled to said operator handle for back and forth sliding movement along said track in response to pivoting movement of said handle, said slide block including means connected to said interconnecting means.

9. The window lock assembly of claim 8 wherein said rack has spaced openings formed therein at positions along the length of said rack generally adjacent said actuator means and said lock device, said actuator means and said lock device each including means in meshed engagement with said rack.

10. The window lock assembly of claim 8 further including means for pivotally supporting said handle directly to said second frame component.

11. The window lock assembly of claim 8 wherein said interconnecting means comprises an elongated rack having spaced openings therein, said slide block having teeth meshed within said openings of said rack.

12. The window lock assembly of claim 8 wherein said lock device comprises a locking cam unit having a housing mounted substantially flush within said second frame component, and a locking cam rotatably received within said housing, said locking cam including means connected to said interconnecting means.

13. The window lock assembly of claim 12 wherein said interconnecting means comprises an elongated rack with spaced openings therein, said locking cam having teeth thereon meshed within said openings of said rack.

14. The window lock assembly of claim 13 wherein said locking cam includes a part cylindrical surface having said teeth thereon, and recessed cam surface including a draw surface and a set a surface separated from each other by a raised ridge, said keeper means being engaged by said draw surface to draw said first frame component toward a tightly closed position upon rotation of said locking cam toward said closed position, said keeper means being engaged by said seat surface to retain the first frame component in the tightly closed position.

15. The window lock assembly of claim 14 wherein said locking cam and said housing therefor include cooperating means for rotatably supporting said locking cam within said housing.

16. The window lock assembly of claim 14 wherein said keeper means includes a keeper roller and keeper blade supporting said roller, said cam housing having an opening therein for receiving said keeper roller and blade and further including a contoured seat surface for receiving and supporting said blade, said locking cam being engageable with said roller.

17. The window lock assembly of claim 8 wherein said first frame component comprises a movable sash and said second frame component comprises a stationary casement.

* * * * *